United States Patent [19]

Ferrentino et al.

[11] 4,112,660

[45] Sep. 12, 1978

[54] APPARATUS FOR LAYING-UP TOGETHER A PLURALITY OF FRAGILE FILAMENTS

[75] Inventors: Antonio Ferrentino, Monza, Milan; Antonio Brovedan, Milan, both of Italy

[73] Assignee: Industrie Pirelli Societa per Azioni, Milan, Italy

[21] Appl. No.: 829,003

[22] Filed: Aug. 30, 1977

[30] Foreign Application Priority Data

Sep. 3, 1976 [IT] Italy ..... 26807 A/76

[51] Int. Cl.[2] ..... D07B 3/06

[52] U.S. Cl. ..... 57/59; 57/61; 57/106; 242/156

[58] Field of Search ..... 57/13–15, 57/3, 34 R, 59, 60, 19, 61, 62–65, 106; 242/147 R, 156, 156.1, 156.2

[56] References Cited

U.S. PATENT DOCUMENTS

| | | | |
|---|---|---|---|
| 2,277,102 | 3/1942 | Henning et al. | 57/59 |
| 2,412,196 | 12/1946 | Ashbaugh et al. | 57/59 |
| 3,292,356 | 12/1966 | Hinds | 57/59 |
| 3,319,412 | 5/1967 | Winter et al. | 57/59 |
| 3,369,355 | 2/1968 | Burr | 57/34 R |
| 3,555,803 | 1/1971 | Pourtier | 57/59 |
| 3,570,234 | 3/1971 | Friesen | 57/59 |
| 3,651,629 | 3/1972 | Webster | 57/13 |
| 3,732,682 | 5/1973 | Crotty et al. | 57/59 |

*Primary Examiner*—John Petrakes

*Attorney, Agent, or Firm*—Brooks, Haidt, Haffner & Delahunty

[57] ABSTRACT

Apparatus for laying-up fine filaments, i.e. filaments which may be readily broken by bending, tension or torsion stresses, which comprises a rotatable platform carrying a plurality of filament bobbins, each bobbin being supported on the platform so that it can rotate about its own axis and about an axis perpendicular thereto, a drive system for rotating the bobbins about the latter axis as the platform is rotated to produce one rotation of each bobbin about the latter axis with each revolution of the platform, braking means for the bobbins which varies the braking force in accordance with radius of a filament winding on a bobbin, tubular guides extending between each bobbin and the laying-up point and supporting discs intermediate the bobbins and the laying-up point which are rotatable with the platform, the tubular guides being rotatably supported on the discs.

19 Claims, 12 Drawing Figures

Motor
M

Fig. 10.
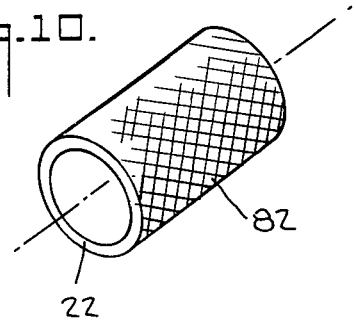
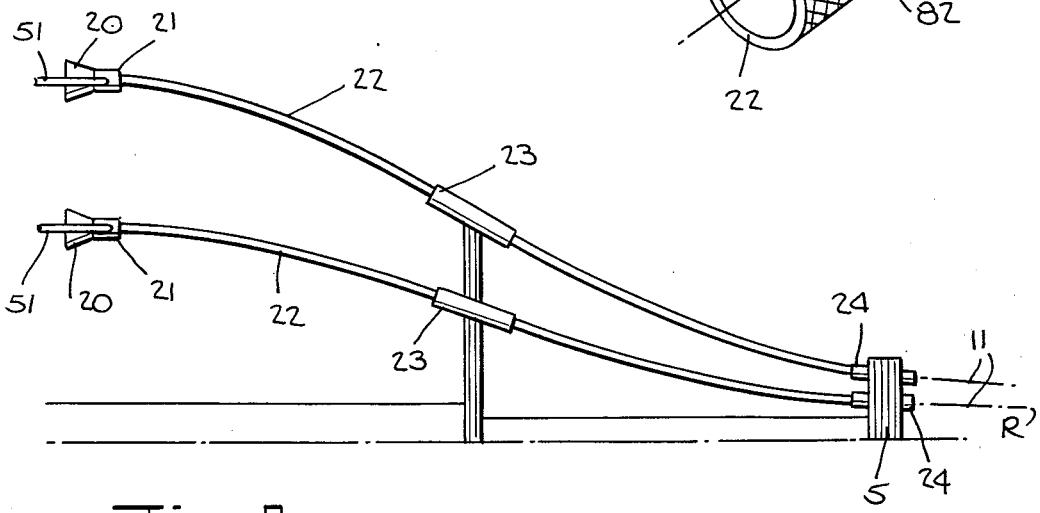
Fig. 8.
Fig. 9.
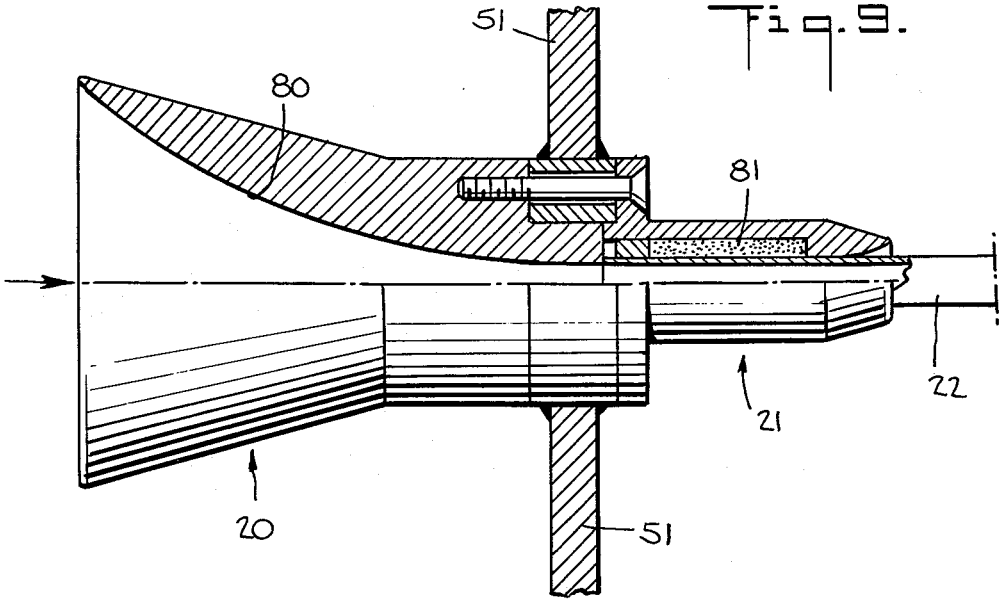

APPARATUS FOR LAYING-UP TOGETHER A PLURALITY OF FRAGILE FILAMENTS

The present invention relates to apparatus suitable for laying up, or helically winding together a plurality of fine filaments. Herein the term "fine filaments" means filaments having a very low capacity for resisting the mechanical stresses to which they are conventionally subjected during the laying together procedure, such as for example, torsion, traction and flexing, which is due either to the dimensions of the said filaments, for example, their very small diameters, or else due to the very nature of the material out of which they are composed, e.g. glass yarn fiber.

Apparatus are well known for laying up a plurality of wires. Under normal operating conditions, such apparatus generally subjects the wires to torsional, tractive and bending stresses from the moment the wires unwind from the bobbins which carry them, until they are layed-up together. When the known apparatus is being employed for laying-up fine filaments, as stated above, they have certain disadvantages, such as the tendency to cause breakage of the said filaments.

As a matter of fact, with respect to these known machines, in the length between the bobbins holding the wires and the joining zone, localized flexures can arise, the magniture of which could cause distortions, or even cause breakage of the said fine filaments owing to their feeble capacity for resisting stresses of this type. Moreover, the said known apparatus necessitates the application of a certain amount of tension stresses to the filaments due to the laying-up together of the said filaments. These tension stresses are caused by means of a braking action normally exerted on the bobbins carrying the filaments.

The braking devices used in the known apparatus, give rise to tension stresses on the wires that are variable in a wide range of values. If, therefore, these braking devices are used for laying together fine filaments, as defined above, deformations can take place which may lead to some breakages in said filaments.

Finally, in the known apparatus, there may exist detorsioning systems capable of preventing the said filaments from becoming subjected to torsional stresses. These de-torsioning systems may, for example, be the type for keeping the axis of the bobbin, during unwinding of the filament, oriented in a pre-established direction. However, these systems are not capable of preventing localized torsional stresses, even small ones, since, in order to prevent excessive flexing of the filaments, it is necessary to guide them from the start of the unwinding of the bobbins to the point where they become layed-up. Hence, these well-known de-torsioning systems, are not applicable for laying up fine filaments, as they give rise to drawback such as breakages in these said filaments.

For the above said reasons, since the fine filaments which have to be layed together are particularly delicate with respect to undergoing the combined stresses of flexing, stretching and torsion, the known apparatus cannot be utilized for them without risking serious drawbacks.

The aim of the present invention is to lay-up together a plurality of fine filaments, as defined before, in such a manner, that each fine filament of the tract, starting right from the unwinding thereof from the bobbin up to the point of being layed-up, is subjcted to stresses due to flexing, pulling, and torsion which are compatible with the mechanical resistance of the said fine filaments.

The object of the present invention is an apparatus suitable for laying-up together a plurality of fine filaments — each filament being unwound off a feeding bobbin, in order to form a strand or bundle of filaments, characterized by the fact that it comprises:

1. means for maintaining constant null torsion on every portion of the said fine filaments during the above unwinding step;

2. means for imposing a constant tension on said fine filaments during said unwinding step until laying-up point is reached.

3. means for guiding said fine filaments towards the said laying-up point in order to impose a pre-fixed limit on the flexing stresses but maintaining on them constant null torsion.

According to a preferred embodiment of the apparatus, the means for constantly maintaining null torsion on every portion of the said fine filaments during their unwinding step, are disposed on one surface of a rotating platform, and joined to supports suitable for carrying the feeding bobbins of said fine filaments, which supports are disposed on the other surface of said platform and face towards said laying-up point.

The means for maintaining constant null torsions on every portion of said fine filaments comprises:

a. rotating elements, each one fitted onto the axis of a support, which consists, by preference, of toothed gears;

b. a circular fixed element, having its own axis coinciding with the axis of said rotating platform, and which preferably, is an annular drive wheel;

c. transmission elements, connecting the said rotating elements, directly or indirectly to the said circular fixed element, said transmission elements being preferably toothed belts.

The means, for imposing a constant tension on the fine filaments, comprises brakes which act on each feeding bobbin, utilizing a variable braking moment depending upon the variations of the unwinding radius of the fine filaments which are wound around each bobbin.

The means for guiding said fine filaments towards the laying-up point, comprises a plurality of flexible tubular guides extending between the said supports, and at least one rotating plate or disc adjacent to the laying-up point. This rotating plate (or plates) has its own axis that coincides with the axis of rotation of said platform, and said plates turn in the same direction and with the same angular velocity as the platform.

Each flexible tubular guide is rigidly fixed, at one of its ends, to each support, and the guide extends through each of the rotating plates, the guide being free, inside said plate or disc to turn around its own axis in the same direction and with the same angular velocity as said supports.

The present invention will be better understood from the following detailed description of the preferred embodiment thereof, which description should be considered in conjunction with the accompanying drawings, in which:

FIG. 8 is a side elevation view of a pair of filament conveyors used in the apparatus of the invention;

FIG. 9 is an enlarged, plan view, partly in cross-section, of an entrance guide for the conveyors illustrated in FIG. 8;

FIG. 10 is an enlarged, perspective view of a portion of a tube forming part of the conveyors illustrated in FIG. 8;

Figure 1:
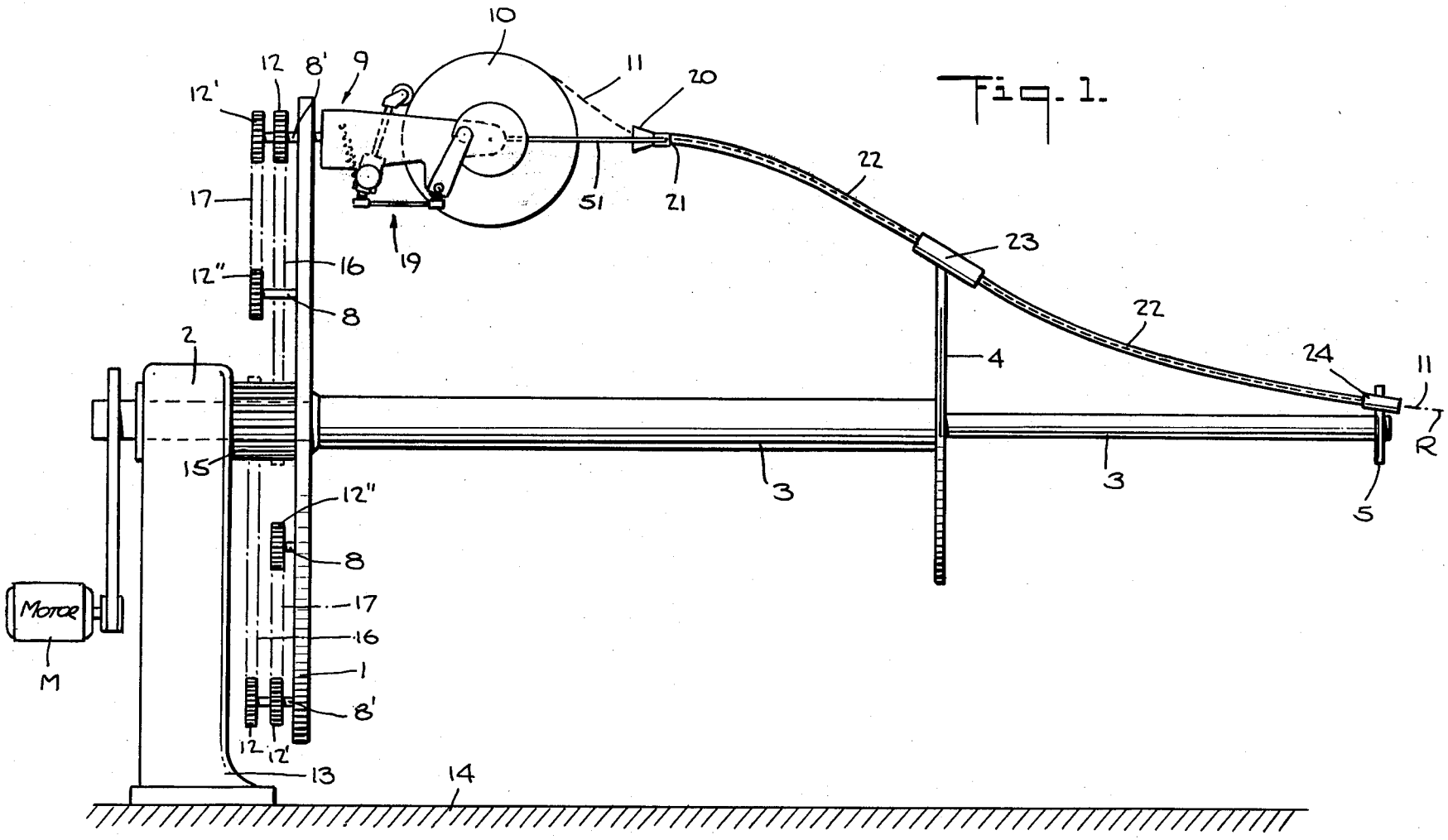
FIG. 1 is side elevation view of the preferred embodiment of the apparatus of the invention with some of the parts removed for ease in illustration.

Referring to FIG. 1, the rotatable platform 1 is rigidly connected to a shaft 2 in such a way that axes of rotation of the rotatable platform 1 and the shaft 2 coincide. The shaft 2 is rotatable around its own axis. At the other surface of the platform 1, there is a shaft 3 that extends up to (without actually reaching it) the laying-up or joining point R. Said shaft 3 is rigidly connected to said platform 1, and the respective axes of rotation coincide.

The shaft 3 has, rigidly joined to it, a first rotatable disc or plate 4 and a second rotatable disc or plate 5. On the rotating platform 1, there are mounted (FIG. 2) along the outline of circles 6 and 7 a plurality of rotatable shafts 8, each shaft 8 being equidistant one from the other and passing through the thickness of said platform. Twelve of these shafts 8 are distributed around the outline of circle 7 and six of these shafts 8 are distributed around the outline of circle 6.

On each shaft 8 and on the side of the platform facing the joining point R, there is mounted a support 9 which holds a bobbin 10 carrying a fine filament 11. Solely by way of example, this fine filament 11 may consist of a metallic thread, or an electric wire of a very small diameter, or even a single filament of glass fiber, optical fibers included.

Although there is a bobbin support 9 on each of the shafts 8 and a drive hereinafter described for each of the four shafts 8 on the circle 7 and each of two shafts on the circle 6, making a total of eighteen bobbin supports and three drives, only one bobbin support and one drive will be described in detail hereinafter, the other supports and drives being identical to the ones described.

One each shaft 8, but opposite to the said supports 9, there are mounted the toothed gears 12. In particular, both the shafts 8 disposed on circle 7, as well as the shafts 8 disposed on circle 6, have a toothed gear 12 mounted on each of them. The shafts marked 8' have two toothed gears mounted therein for the transmission of the movement to gears 12" through gears 12'.

The rotating platform 1 is carried by the shaft 2 which is connected to it and which is mounted in a hole in the end of a vertical column 13 which is fixed to the base 14 of the apparatus. A motor M drives the shaft 2 which causes the platform 1, and all the elements connected to it, to rotate around the axis of the shaft 2. Coaxial with the shaft 2 and independent of it, there is disposed on the vertical column 13 an annular drive wheel 15 that is fixed to the column 13 in such a way so as not to permit it to rotate or to translate with respect to its own axis. The wheel 15 preferably has teeth. The toothed gears 12, 12' and 12" are directly, or indirectly, connected to the wheel 15 by means of the toothed belts 16 and 17. Tension rollers 18 keep the said toothed belts 16 and 17 under tension.

The toothed gears 12, 12' and 12", the wheel 15 and the toothed belts 16 and 17, are means for maintaining constant null torsions on every point of said fine filaments 11. In particular, FIG. 2 shows a partial end view of the apparatus, and primarily, the rotating platform 1.

Figure 2:
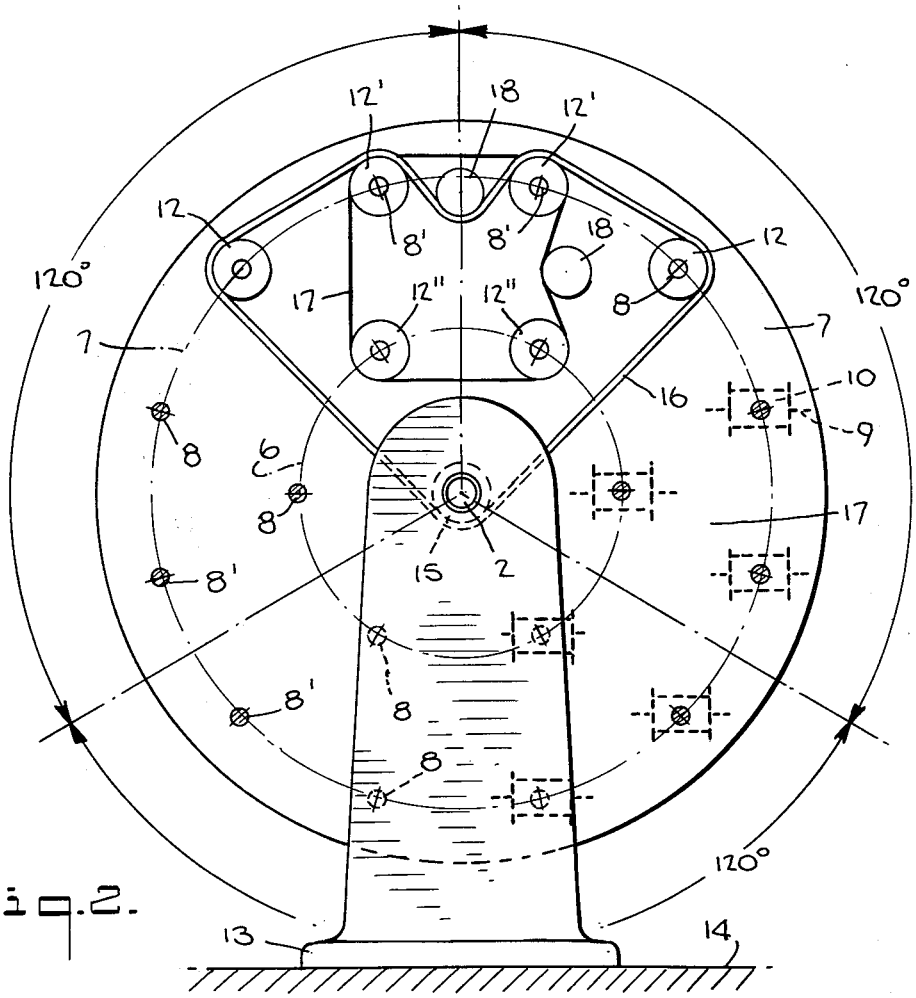
FIG. 2 is an end elevation view, viewed from the left in FIG. 1, of the apparatus in FIG. 1 with some of the parts removed for ease in illustration.

For convenience in illustration, in FIG. 2, there is shown a part of the above said means for maintaining constant null torsions, a part of the supports for the bobbins carrying the fine filament 11, and part of the shaft sections which connect the toothed gears to the supports.

This illustration of all the elements is made according a division of the rotating platform illustration into three adjacent groups (contained in sectors of 120°) where, in the first sector, there are visible the toothed gears 12, 12' and 12", connected either directly, or indirectly, to the wheel 15 by means of toothed belts 16 and 17 and to the tension rollers 18 of the said belts. In the second sector, there are visible, as shown schematically with broken lines, the supports 9 bearing the bobbins 10. In the third sector are visible sections of the shafts 8 which join the toothed gears 12 to the support 9. Referring to FIG. 1, each support 9 is provided with braking means 19 for the feeding bobbin 10 that carries the fine filament 11. The said braking means 19 will be described in more detail further on.

At the end of each support 9 facing the joining point R, there is situated a conveyor 20 for the fine filament 11 that unwinds from the bobbin 10. Each conveyor 20 comprises a housing 21 into which is placed a flexible tubular guide 22 in which the fine filament 11 slides. The said conveyor 20 and the housing 21 will later be described in further detail.

Each flexible tubular guide 22 that extends toward the joining point R, passes through an intermediate housing 23 situated on the first rotating disc 4, and successively goes into a terminal housing 24 situated on the second rotating disc 5. Each flexible tubular guide 22 is free to rotate around its own axis on the inside of each housing 23 and 24.

The second disc 5 has a diameter which is smaller relative to that of the first disc 4 and of the platform 1. The said discs 4 and 5 are space apart at intervals from each other, and with respect to the supports 9 (in particular, with respect to the support extremity facing towards the joining point R) and spaced apart from the joining point R, the said intervals being of approximately the same order of magnititude.

Each flexible tubular guide 22 extends between each housing 21 and the corresponding housing 23 disposed on the first disc 4 according to a configuration that, for its greater part, presents a curvature with its concavity facing in the direction of the axis of the apparatus. Said flexible tubular guide 22 in the portion comprised between each housing 23 on the said first disc 4, and the corresponding housing 24 disposed on the second disc 5 has a configuration which presents, for the greater part, a curvature with its concavity facing in the direction opposite with respect to the axis of the apparatus.

The flexible tubular guides 21 and the housings 23 and 24 together with the first disc 4 and the second disc 5 will be later described in further detail.

Figure 3:
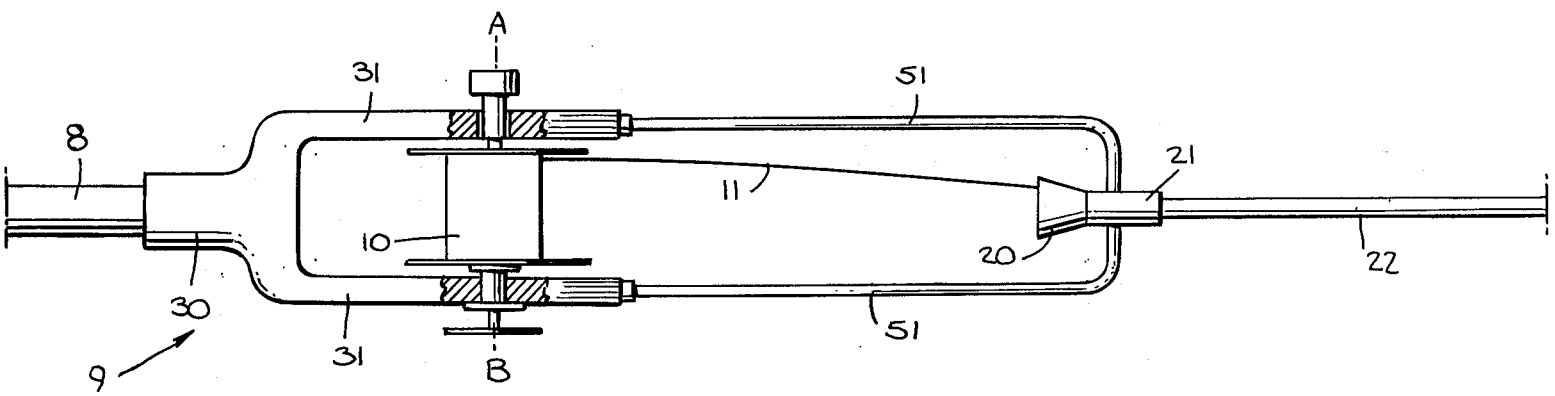
FIGS. 3 & 4 are, respectively, enlarged plan and side elevation views of a portion of the apparatus shown in FIG. 1.
Figure 4:
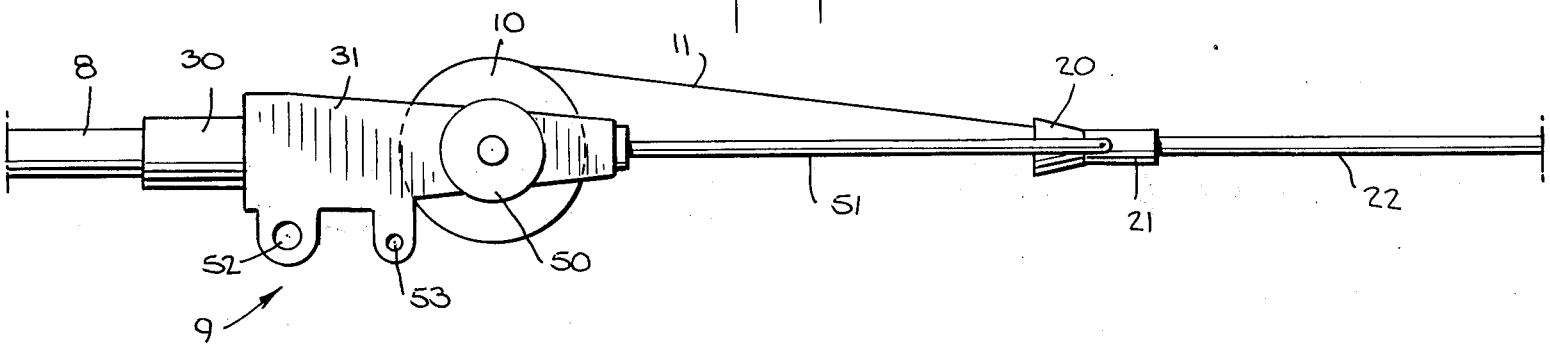

FIGS. 3 and 4 show, respectively, a plan view and a side view of one of the supports 9 on which the bobbin 10 is mounted. Said support 9 comprises a body 30 from which two parallel arms 31 extend, the arms being spaced apart from each other and having a length such as to contain the above said bobbin 10.

Figure 5:
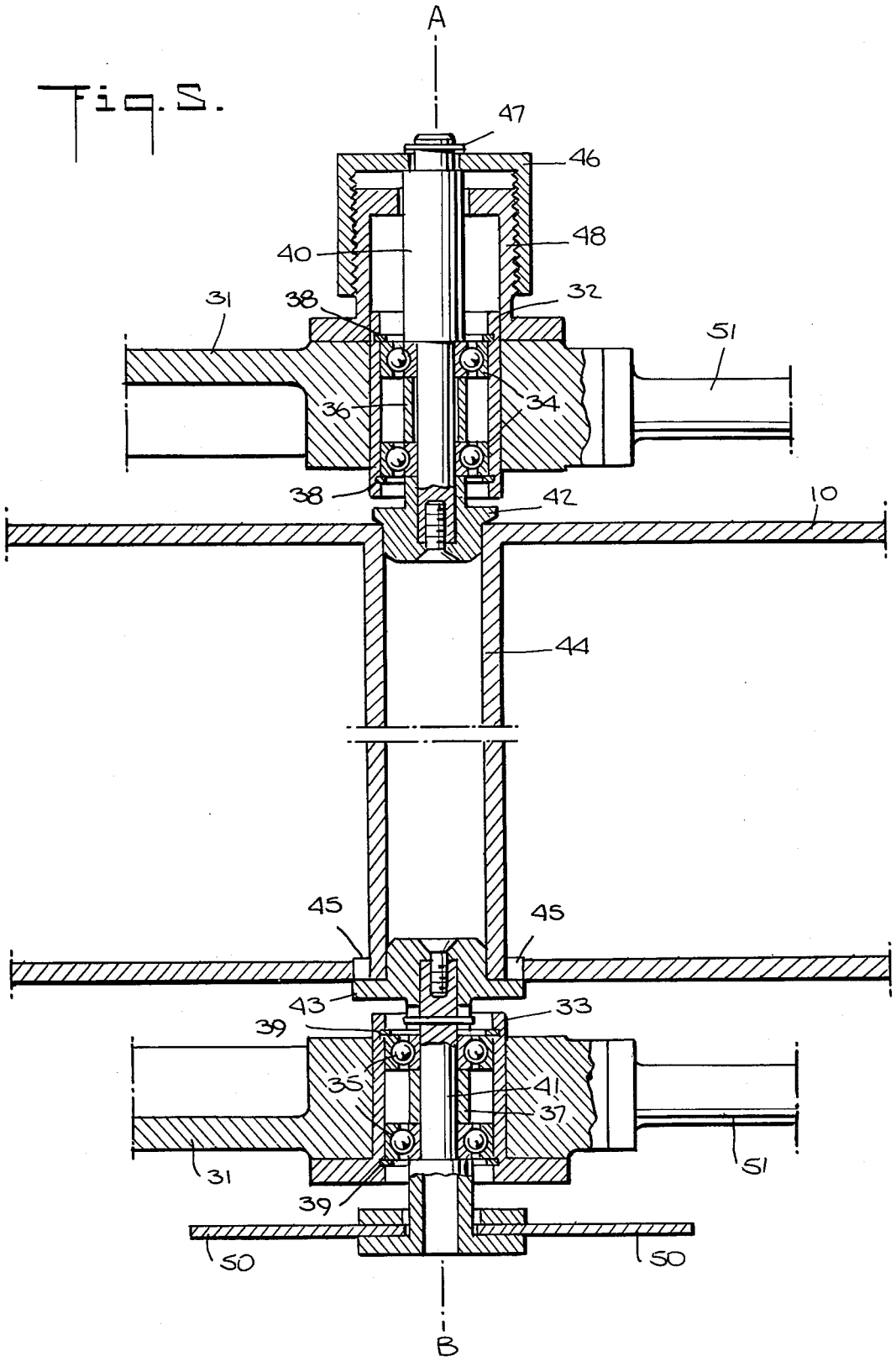
FIG. 5 is an enlarged, fragmentary cross-sectional view of the bobbin supporting apparatus shown in FIGS. 3 & 4 and is taken along the axis A-B indicated in FIG. 3.

In each of said arms 31, there is formed a through-hole with its axis A-B perpendicular to the longitudinal axis of the support 9 itself. In said through-holes, there are disposed (FIG. 5) bushings 32 and 33 respectively, in which are situated bearings 34 and 35 spaced apart from each other by means of the spacers 36 and 37 and maintained in the said position by means of spring washers 38 and 39. The shafts 40 and 41 are mounted respectively, on bearings 34 and 35, and each has, on its extremity facing the longitudinal axis of the support 9, the cylindrical covers 42 and 43 that are received in the ends of the hollow core 44 of the bobbin 10.

In particular, the cover 43 is provided with teeth 45 which engage with the walls of corresponding holes in the bobbin 10. The bobbin 10 held by means of the said cover, is locked or unlocked axially, by means of the locking nut 46, which is joined to the end of shaft 40 by means of a spring washer 47. The nut 46 is screwed on a body 48 causing axial movement of the shaft 40 which serves for locking, or unlocking, the said bobbin 10, without preventing the bobbin 10 itself from rotating around its own axis. The shaft 41 cannot accomplish any axial displacements, but it can rotate around its own axis together with the said bobbin 10. The rotation of the cover 43 is transmitted to a disc 50 by means of the shaft 41.

The parallel arms 31 are connected, respectively, at their extremities to the extensions 51 which lead to the conveyor 20 and to the housing 21 of the flexible tubular guide 22. The support 9 is, moreover, (See FIG. 4) provided with holes 52 and 53 which are spaced apart from each other and which have their own axes parallel to one another and perpendicular to the longitudinal axis of support 9. In these holes, the braking means 19 of the bobbin 10 (visible in FIG. 1) are mounted. The details of the braking means 19 are illustrated in FIGS. 6 and 7.

Figure 6:
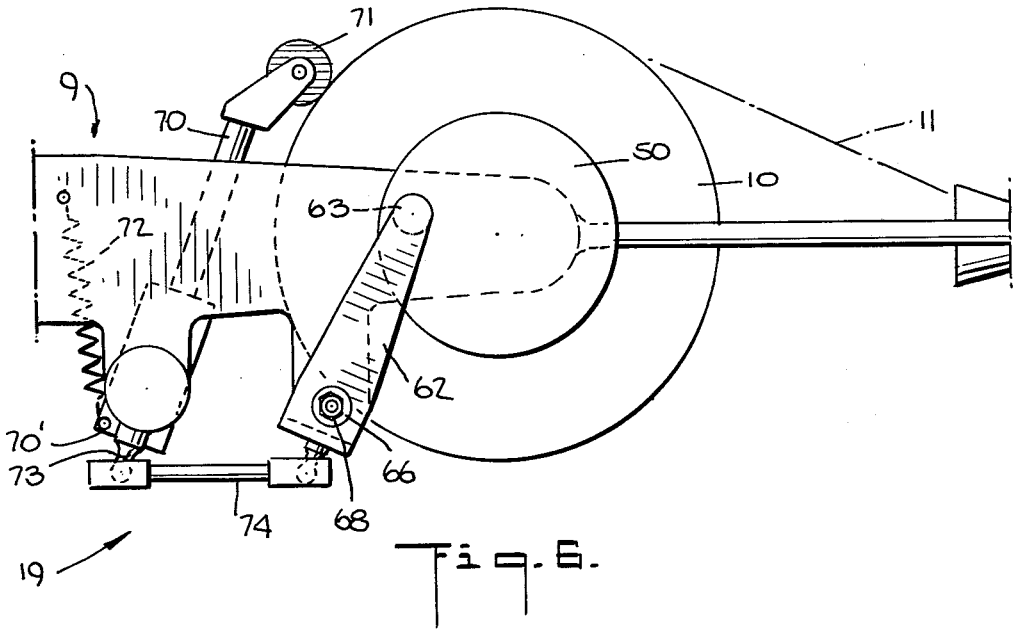
FIGS. 6 & 7 are, respectively, side elevation and plan views of the bobbin braking apparatus employed in the preferred embodiment of the invention.
Figure 7:
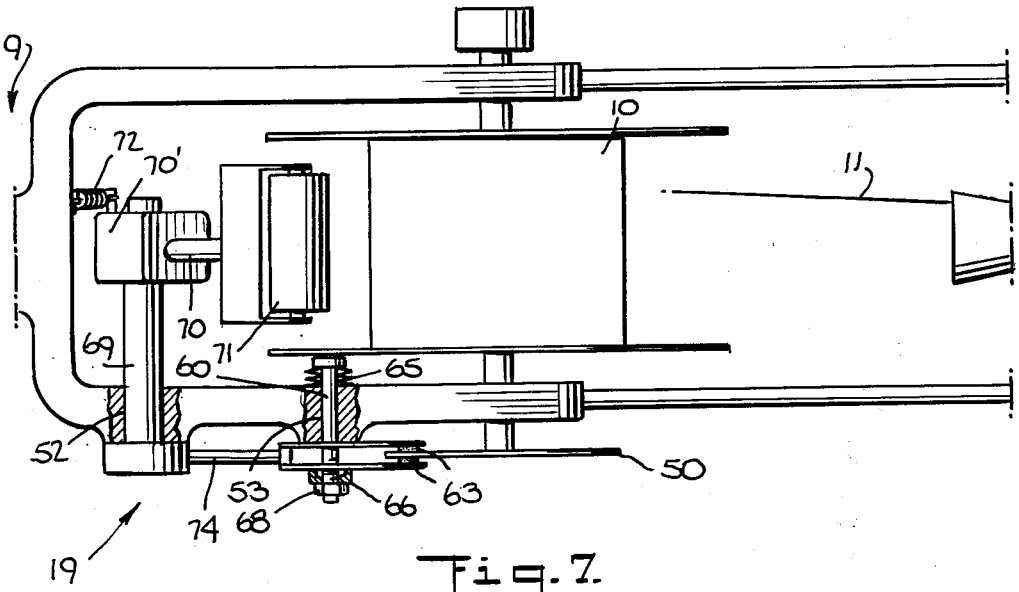

In FIGS. 6 and 7, there are illustrated a side view and a plan view of the braking means in which, inside the hole 53 in the said support 9 (seen in FIG. 7), is situated a shaft 60, having a greater length than the holes 53, so as to protrude with respect to hole 53. Near to one end of said shaft 60 are mounted segments 62. Said segments 62 carry, on their facing surfaces, at their free ends, the pads 63 which are in contact with the opposite surfaces of the disc 50 together with which they form the braking elements of the system.

The shaft 60 passes through the central holes of a series of Belleville washers 65, through the holes in the segments 62 and through the central hole of the cover 66 and is secured by a threaded nut 68. The nut 68 controls the compression forces of the washers 65 by means of the cover 66. This force is transmitted to segments 62 and thence, to the pads 63. The above segments 62, disposed as aforesaid, constitute a lever and can accomplish angular displacements by rotating around the shaft 60 on which they are pivotally mounted.

In the hole 52 (visible in FIGS. 4 and 7), there is mounted a shaft 69 which has its own axis perpendicular to the longitudinal axis of the support 9. On this shaft 69 at the extremity facing the inside of the said support 9, there is mounted the element which is sensitive to the variations of the unwinding radius of the fine filaments 11 wound around the bobbin 10. This element is, an arm 70 which carries a roller 71 which idles about its axis and having a length such as to substantially cover the entire axial length of the surface covered by the fine filament 11. This roller, is held in contact with said surface by means of a spring 72, the extremities of which are fixed respectively to the support 9 and to the free extremity 70' of the arm 70.

The shaft 69 on its extremity external to said support 9 is provided with an arm 73 which is disposed in such a way as to be an extension of the arm 70. The arm 73 and the segments 62 are pivotally connected to a tie-rod 74 which interconnects them.

Since the fine filaments to be laid up should not be subjected to stresses exceeding 100 gr., the contacting elements of the braking system have been selected to have a friction coefficient not greater than 0.1. In order to obtain such coefficient a coupling of material commonly known in the market by the name of "Teflon" with chromium-plated steel, i.e. pads 63 made of "Teflon" and the disc 50 made of steel with the surfaces specular and plated with chromium, may be used. This combination of braking means guarantees an insignificant static friction and an insignificant inertia force which follows when the apparatus is stopped.

FIG. 9 shows a side view (partly in cross-section) of the conveyor 20 of the fine filaments 11 and the housing 21 of the flexible tubular guide 22, both of which are mounted on the end of the extensions 51 of the support 9 which face the joining point R. The said conveyor 20 contains a through hole which, starting from a diameter of a certain dimension, progressively diminishes its dimension until it has a diameter equal to that of the inside diameter of the flexible tubular guide 22 according to a surface which has its circular generatrix 80 of a radius not less than the radius of the curvature acceptable for the fine filament to be laid up, e.g. 200 mm.

The end of said conveyor 20 is rigidly fixed to the extensions 51 of the support 9 and has joined to it the housing 21 inside of which the flexible tubular guide 22 is disposed and rigidly joined by means of an attaching substance 81, e.g. an adhesive.

In FIG. 8, there is shown a side view of the said flexible tubular guides as disposed in the housing 21, and which pass through the housings 23 and 24 situated respectively on the rotating discs 4 and 5. On the disc 4, the number of housings 23 correspond with the number of the bobbins 10 disposed on the rotating platform 1 and they are disposed along the lay-out of two concentric circles co-axial with the shaft 3. Both said circles have a lesser diameter with respect to the corresponding circles on which the bobbins 10 are disposed on the rotating platform 1.

On the disc 5, the number of the housings 24 is always equal to the number of bobbins 10 disposed on the rotating platform 1, and they are disposed along the lay-out of two concentric circles co-axial with the shaft 3. Both said circles have a lesser diameter than the corresponding circles on the disc 4. As an alternative, the housings 24 can be disposed along a single circle which has a diameter smaller than the diameter of both the circles on the disc 4.

Said flexible tubular guides 22 have a circular or substantially circular cross-section, and they are anchored, by any suitable mechanical means, to the housings 23 and 24 respectively in such a way that no axial displacements can take place, but the flexible tubular guides 22 can, however, rotate together with said housings, around their own axes.

The fine filaments 11, when passing through the interior of the tubular guides 22 and in coming into contact with said guides 22, do not have to encounter any friction over a coefficient of 0.1 during this contact. From among the various suitable types of materials which can be used for constructing said guides 22, "Teflon" is mentioned as being quite suitable for the purpose. Preferably, the guides 22 have an outer covering consisting of a metallic braid suitable for anchoring it to the respective housings. In particular, FIG. 10 shows a metallic covering 82 for said guides which service for anchoring them. The curvatures of the guides 22 along their axes are such that, in their turn, the fine filaments 11 assume curvatures having a radius of not less than 200 mm.

Figure 11:
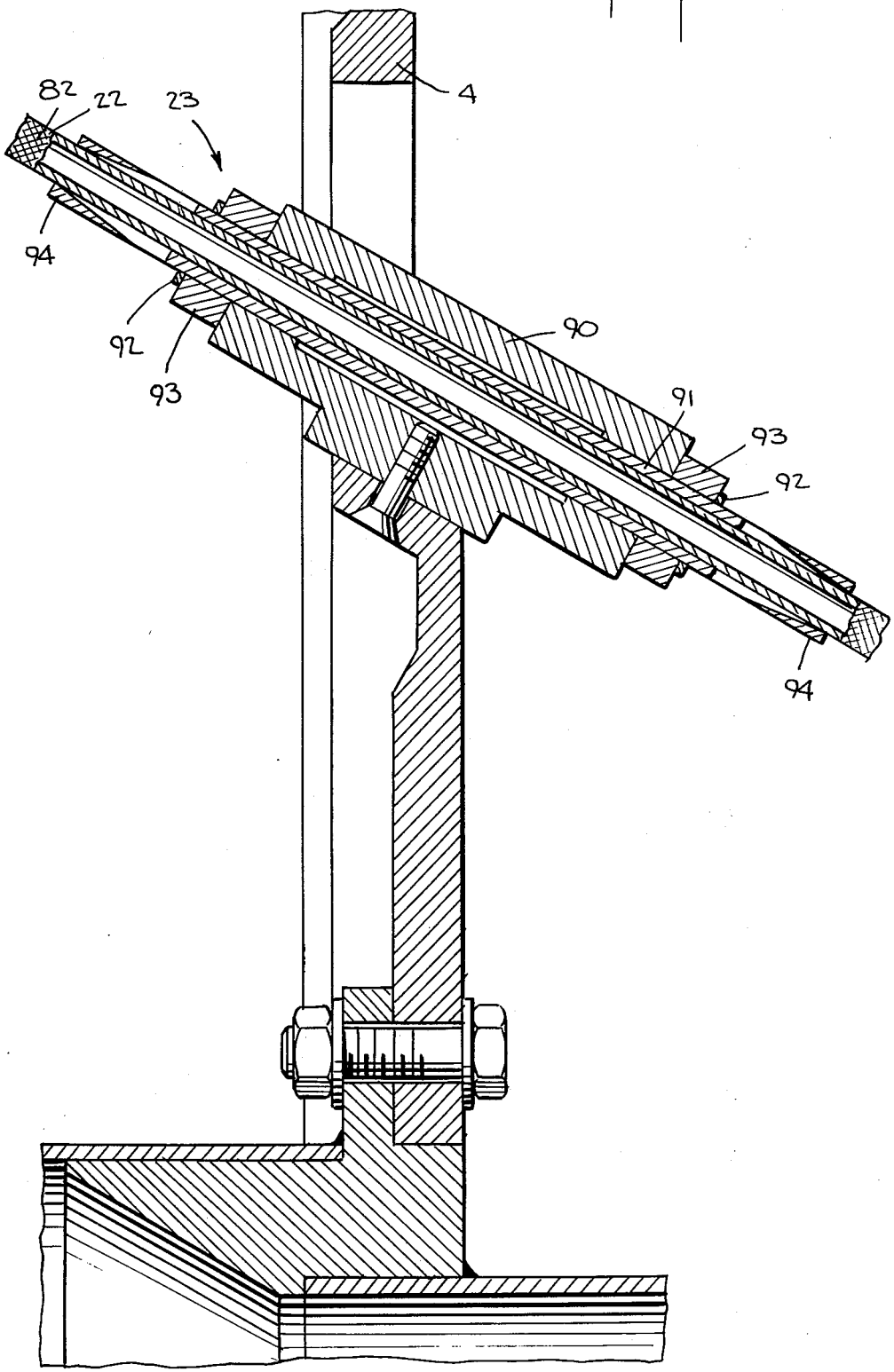
FIG. 11 is an enlarged, cross-sectional view of an intermediate support for the conveyors illustrated in FIG. 8.

FIG. 11 shows a vertical cross-section of the housing 23 disposed on the rotating disc 4. A body 90 is fixed to the side disc 4 and has a hole extending throughout its length. On the inside of said hole, there is placed a tube 91 whose length is greater than that of the body 90 so that the extremities of said tube protrude externally from said body 90. Said tube 91 is maintained in its position by means of spring washers 92 placed on it, and in contact with bushings 93 which, in their turn, are disposed on said tube 91 and are in contact with the body 90. The tube 91 thus disposed, cannot carry out axial displacements, but, at the same time, it is free to rotate around its own axis. The flexible tubular guide 22 passes throughout the inside of tube 91 and is anchored to said tube 91 by means of bushings 94 acting at the extremities of the said tube 91 and locking it onto the metallic covering 82 of the guide 22 itself.

Figure 12:
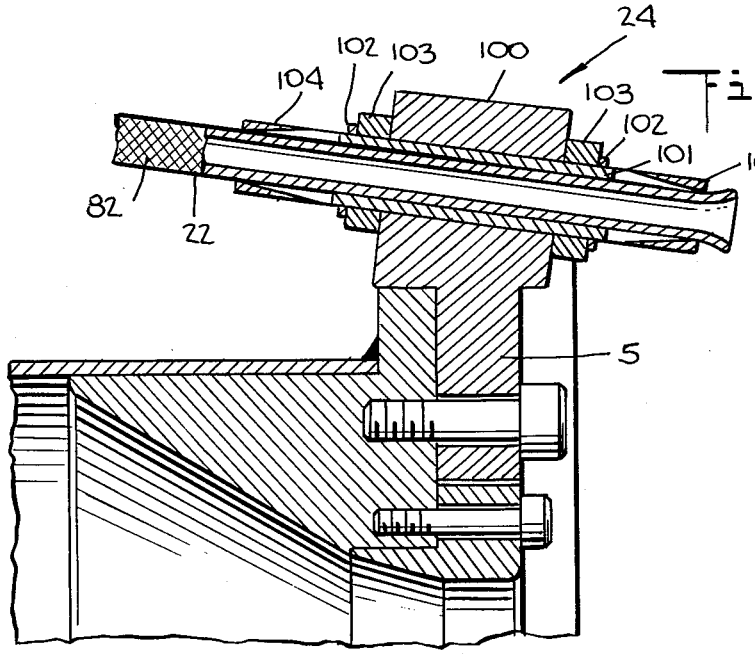
FIG. 12 is an enlarged, cross-sectional view of a support for the exit ends of the conveyors illustrated in FIG. 8.

Finally, in FIG. 12, there is shown a cross-section of the housing 24 held by a body 100 which is secured to the rotating disc 5. The body 100 has peripheral holes, disposed on the layout of a single circle and in a number equalling the number of the bobbins 10 which are disposed on the rotating platform 1. In each hole, there is placed a tube 101, which has a greater length with respect to said body 100 so as to protrude externally to the extremities of the body 100.

Analogously, as in the case of the tube 91 of FIG. 11, the tube 101 is maintained in its position by means of the elastic washers 102 disposed on it, the tube 101 being in contact with bushings 103 which are in their turn disposed on the said tube 101 and in contact with the body 100. The tube 101 thus disposed, cannot carry out axial displacement but, at the same time, it is free to rotate around its own axis.

The flexible tubular guide 22 passes through the inside of the tube 101 and it is anchored to the tube by means of bushings 104 acting on the extremities of said tube 101 which lock it on the metallic covering 82 of the guide 22 itself.

To illustrate the operation of the apparatus, let it be assumed that the cycle of operation is initiated at the moment the motor M transmits rotary motion to the platform 1 by means of shaft 2 which is connected to it. The fine filaments 11 have previously been fed manually through the conveyors 20 and the guide tubes 22 and secured at the point R to a conventional stranded filament pulling mechanism. The platform causes all the elements connected to it to rotate along with it (See FIGS. 1 and 2). Simultaneously with the rotation of the platform 1, the fine filaments 11 are pulled away from the joining point R by conventional means, and they unwind with a pre-set linear velocity from the bobbin 10 and pass through the inside of the flexible tubular guide 22.

The result of the combined movements, rotation of the platform, and linear movement of the fine filaments 11 is the pitch of the fine filaments laid up with each other.

Rotation of the platform 1 compels the toothed belt 16 to effect displacements on the fixed plate wheel 15 in the opposite direction with respect to the rotation direction of the platform 1 itself. The displacements of the toothed belt 16 are transmitted to the toothed gears 12, 12' and 12'' which rotate in their turn, in the inverse direction with respect to that of the platform, but with the same angular velocity. The supports 9 joined to said toothed gears by means of the shafts 8 have the very same rotational direction and the same angular speed, and therefore, during the rotation of the platform 1, each support 9 will have, in every point of the rotation its arms 31 always parallel to the horizontal plane of the apparatus. The gears 12, 12' and 12'' and the wheel 15 are selected so that the supports 9 make one revolution for each revolution of the platform 1. The direction and the angular velocity of the platform 1 are transmitted to the shaft 3 joined to it and to the discs 4 and 5 secured to the shaft 3.

This way of operating the apparatus ensures that the fine filaments 11 carried by the bobbins 10, on issuing from the bobbins 10 maintain their generatrix parallel to their own axis, i.e. no torsional mechanical stresses are suffered by any of the fine filament 11.

The fine filament 11 on issuing from the bobbin 10 is conveyed to the inside of the flexible tubular guide 22 by means of the conveyor 20. Passing into the inside of said flexible guide 22, the fine filaments 11 follow the course defined by the curvature assigned to the said flexible tubular guides 22.

When the apparatus is functioning, each of the flexible tubular guides 22 rotates within the housings 23 and 24, disposed on the rotating discs 4 and 5, in the same sense and with the same angular velocity, as the supports 9 of the bobbins 10, for which reason, any section whatsoever, of said flexible guide 22 is subject to a revolving movement around the axis 3 of the shaft 3, but it does not rotate around its own center. In this way, the flexible tubular guides 22 cannot generate torsional stresses in the fine filaments 11, and hence, the condition of the absence of mechanical torsional stresses on each fine filament 11 as they issue from the bobbin 10, is maintained during the passage of said fine filaments 11 within said flexible tubular guides 22, up to the joining point R.

Besides this, since the fine filaments 11 follow the course imposed by the curvatures of the said flexible tubular guide 22, and since these selected curvatures are very slight as above exemplified, it follows that the fine filaments 11 are subject to modest flexing stresses distributed along the whole course, from their exiting from the bobbin 10 until they reach the joining point R, and concentrated flexing stresses of an excessive value are avoided.

Moreover, the bobbin 10 is braked by braking means 19 during its rotation around its own axis. The operation of said means 19, which is made clearer by examining FIGS. 6 and 7, is such that the arm 70 responds to the continuously diminishing radius of the winding of the fine filaments 11 by means of the roller 71.

As the filament 11 unwinds, the arm 70 moves towards the axis of the bobbin 10, helped in its displacement by the action of the spring 72. At the same time, this displacement is transmitted, in a way that is proportional to the lever constituted by segments 62, by means of the tie-rods 74 which connect the arm 73 to the free extremity of the said segments 62. The pads 63, that are braking elements, are pressed against the disc surface 50 with a pre-fixed force, by means of the washers 65 compressed by the shaft 60, and the arm 70 through the tie-rod 74 changes the dimension of the radius of application of the braking force by the segments 62, said segments 62 moving said pads 63 from the edges towards the axis of the disc 50.

From what has been stated, the braking of each bobbin 10 is such, that the braking moment varies according to the variations of the dragging moment, which in turn, depends upon the variations of the unwinding radius of the filaments 11 on the bobbin 10. By diminishing the unwinding radius of the fine filaments 11, the application radius of the braking force is also diminished, thereby obtaining a constant tension on the fine filaments 11 from the time the bobbin 10 is full until the time when the bobbin 10 is emptied. Accordingly, the fine filaments 11 do not suffer any variable stresses which could cause them to break. Another aspect which is relevant to this type of braking is that the brake itself, renders negligible the difference between the friction value of the static friction, and the friction values in motion which determine the forces along the axis of the fine filament and during the stopping. Also, when starting the apparatus, little inertia is present which could otherwise cause abnormal stresses on the fine fialment 11.

Although the apparatus of the invention has been described in connection with the laying up of 18 fine filaments, it will be apparent to those skilled in the art that a greater or lesser number of filaments may be laid up by using a greater or lesser number of bobbins 10. Thus, the bobbins 10 not required and their drives, etc. may be omitted, or they may merely not be used.

Although a preferred embodiment of the present invention have been described and illustrated, it will be understood by those skilled in the art that various modifications may be made without departing from the principles of the invention.

We claim:

1. Apparatus for laying up a plurality of fine filaments comprising:

a platform for rotation around a first axis;

a plurality of bobbins, one for each of said filaments, each bobbin having a second axis about which it rotates when a filament is fed therefrom;

a plurality of bobbin support means, one for each of said bobbins, mounted on said platform and, rotatably mounting said bobbins around and spaced from said first-mentioned axis, said support means mounting said bobbins for rotation both around a third axis parallel to said first axis and perpendicular to the bobbin second axis and around said second axis;

driving means connected to said bobbin support means for rotating said bobbins around said third axis with rotation of said platform around said first axis but in a direction opposite to the direction of rotation of said platform;

braking means connected to said bobbins for braking them as the filaments are unwound therefrom and maintaining a constant tension on the filaments;

and filament support means from said bobbins on the side thereof opposite from said platform, said filament support means comprising a plurality guide tubes, one for each filament, each guide tube extending from adjacent a bobbin to a laying-up point spaced from said platform, means securing one end of each tube to a bobbin support means and tube supporting means rotatably supporting each guide tube.

2. Apparatus as set forth in claim 1 wherein said platform is mounted on a rotatable shaft co-axial with said first axis and said platform has a pair of faces perpendicular to said first axis, wherein each of said bobbin support means comprises means for receiving and rotatably supporting a bobbin with its axis of rotation parallel to one of said faces and means rotatably mounting said receiving and supporting means on said one of said faces with said third axis thereof perpendicular to said one of said faces and spaced from said first axis and wherein said driving means comprises a wheel in fixed relation to said shaft and co-axial therewith and drive means interconnecting said wheel and said bobbin support means whereby rotation of said shaft and said platform in one direction causes opposite rotation of each of said bobbin support means in synchronism with the rotation of said shaft.

3. Apparatus as set forth in claim 2 wherein each of said means rotatably mounting said receiving and supporting means comprises a further shaft rotatably mounted on said platform and wherein said drive means comprises means interconnecting said wheel and said further shaft for rotating said further shaft and said receiving and supporting means one revolution for each revolution of said platform.

4. Apparatus as set forth in claim 3 wherein each said further shaft extends outwardly to the other face of said platform and wherein said drive means comprises a gear on said further shaft at said other face of said platform and driving means interconnecting said gear and said wheel.

5. Apparatus as set forth in claim 4 wherein each further shaft is disposed on a circle centered on said first axis and the spacing between each further shaft and the next adjacent further shafts is the same for all further shafts.

6. Apparatus as set forth in claim 4 wherein a first plurality of said further shafts are disposed on a first circle centered on said first axis and are equally spaced, wherein a second plurality of said further shafts, fewer in number than the first plurality thereof, are disposed on a second circle smaller than said first circle and having the same center as said first circle, said second plurality of further shafts being equally spaced, and wherein said driving means interconnects gears on said first plurality of further shafts with gears on said second plurality of further shafts.

7. Apparatus as set forth in claim 1 wherein each of said support means comprises a body having a pair of spaced arms receiving a bobbin therebetween and supporting means on said arms supporting and axially locking said last-mentioned bobbin while permitting it to rotate.

8. Apparatus as set forth in claim 7 wherein said support means comprises a pair of bobbin shafts respectively rotatably mounted on one of said arms, locking means engaging and preventing axial movement of one of said bobbin shafts and adjusting means enagaging the other of said bobbin shafts for adjusting the axial position thereof.

9. Apparatus as set forth in claim 1 wherein said braking means comprises a brake disc connected to each said bobbin and rotatable therewith, a braking lever engaging said brake-disc and movable toward and away from the axis of rotation of said brake disc, adjustable means urging said lever against said brake disc, a further lever with means engageable with the winding of filament on said last-mentioned bobbin and means interconnecting said braking lever and said further lever for moving said braking lever toward said axis of rotation of said brake disc with a decrease in the radius of said winding.

10. Apparatus as set forth in claim 9 wherein said means engageable with said winding lever is an idler roller rotatably mounted on said further lever.

11. Apparatus as set forth in claim 10 wherein said idler roller has an axial length substantially equal to the axial length of said winding.

12. Apparatus as set forth in claim 9 wherein said braking lever has a pad thereon engaging said brake disc, said pad having a diameter less than the radius of said brake disc.

13. Apparatus as set forth in claim 1 wherein said tube supporting means comprises at least one disc mounted for rotation with said platform around said first axis, a plurality of tube housings, equal in number to the number of said bobbins, disposed on said disc in equally spaced relation on at least one circle centered on said first axis, each said housing rotatably supporting one said tube and said circle being small in radius than the respective spacings, with respect to said first axis, of the bobbins from which the filaments are fed through the tubes supported by the housings.

14. Apparatus as set forth in claim 13 wherein said disc is mounted on a supporting shaft which extends from said platform and is in spaced relation to said platform, and further comprising a further disc mounted on said supporting shaft in spaced relation to said first-mentioned disc and on the opposite side thereof with respect to said platform, a plurality of further tube housings, equal in number to the number of said bobbins, disposed on said further disc in equally spaced relation on a further circle centered on said first axis, each said further housing rotatably supporting one said tube and said further circle being smaller than the smallest circle on which said first-mentioned housings are disposed.

15. Apparatus as set forth in claim 14 wherein each said housing comprises a tube extending therethrough and rotatable therein and means securing said last-mentioned tube to the guide tube supported by the housing.

16. Apparatus as set forth in claim 14 wherein each said guide tube curves away from said first axis between a bobbin support means and said first-mentioned disc and curves toward said first axis between said first-mentioned disc and said further disc.

17. Apparatus as set forth in claim 1 wherein each of said guide tubes is flexible.

18. Apparatus as set forth in claim 17 wherein each of said guide tubes is made of a plastics material.

19. Apparatus as set forth in claim 17 further comprising a conveyor secured to each guide tube at the end thereof nearer a bobbin, said conveyor being tubular and having an inner surface which is curved in cross section, the diameter decreasing from the end thereof nearer a bobbin to the end thereof nearer a guide tube.

* * * * *